US005488278A

United States Patent [19]

McGraw et al.

[11] Patent Number: 5,488,278

[45] Date of Patent: Jan. 30, 1996

[54] LOAD LIMIT SYSTEM FOR MECHANICAL LINEAR ACTUATOR

[75] Inventors: Peter S. McGraw, Severna Park; Charles M. Kelly, Annapolis, both of Md.

[73] Assignee: The United States of America as represented by the Secretary of the Navy, Washington, D.C.

[21] Appl. No.: 311,633

[22] Filed: Sep. 23, 1994

[51] Int. Cl.[6] ..... G05G 5/00

[52] U.S. Cl. ..... 318/626; 318/135; 318/687; 318/466

[58] Field of Search ..... 318/135, 626, 318/611, 648, 466–469, 687

[56] References Cited

U.S. PATENT DOCUMENTS 3,703,999 11/1972 Forys et al. ..... 248/20
4,477,755 10/1984 Rickett ..... 318/611
4,969,662 11/1990 Stuart ..... 280/707
5,323,012 6/1994 Auslander et al. ..... 250/492.2
5,366,236 11/1994 Kuriki et al. ..... 280/707

*Primary Examiner*—David S. Martin
*Attorney, Agent, or Firm*—Charles D. Miller; Gary G. Borda

[57] ABSTRACT

A load limit system is provided for a linear actuator. An interface is attached to the linear actuator and is disposed between first and second spring assemblies. A first sensor senses a first amount of linear compression of the first spring assembly along a first direction. A second sensor senses a second amount of linear compression of the second spring assembly along a second direction. Movement of the linear actuator in the first direction ceases whenever the first amount of linear compression is sensed. Movement of the linear actuator in the second direction ceases whenever the second amount of linear compression is sensed.

8 Claims, 1 Drawing Sheet

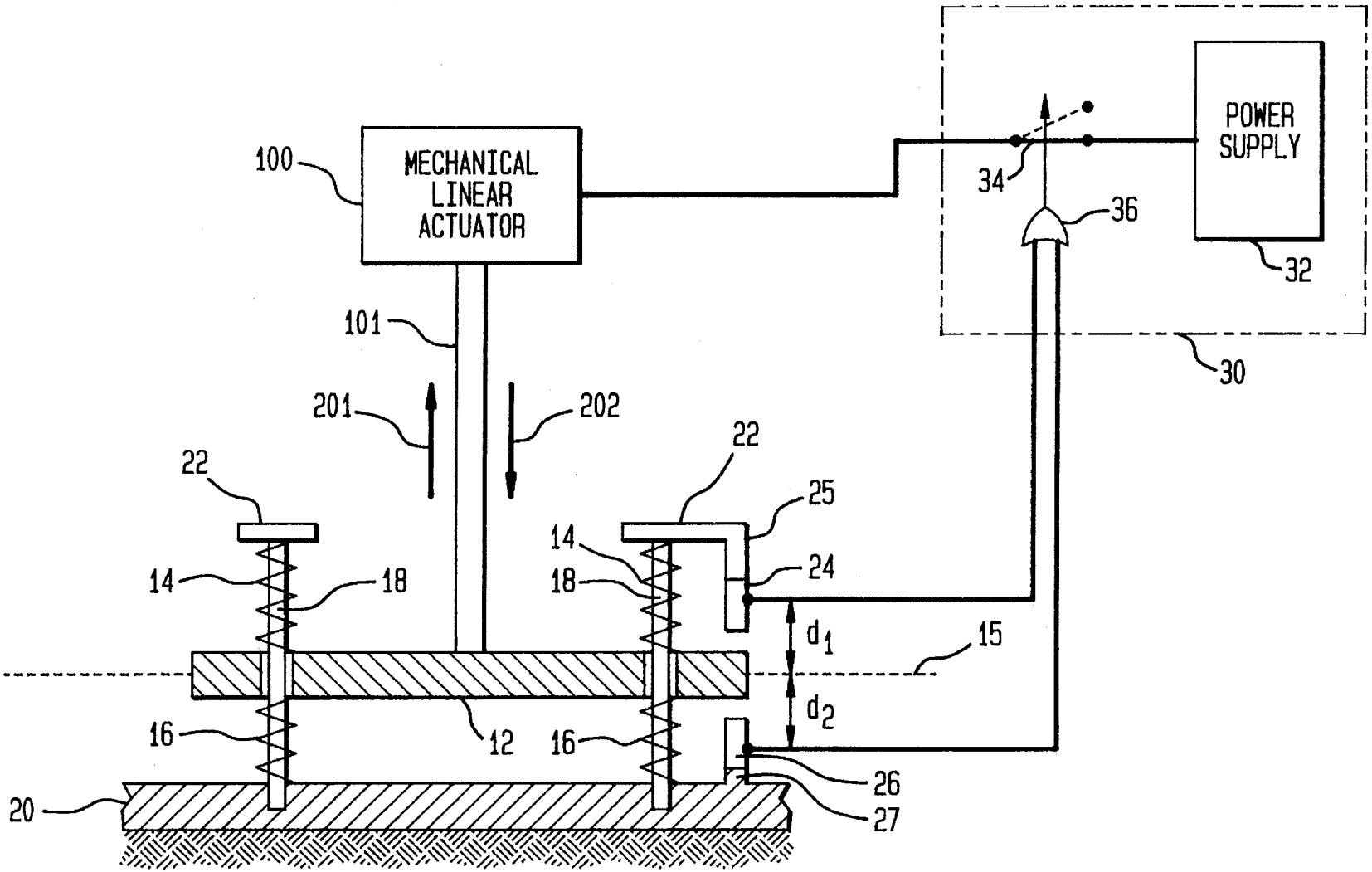
POWER SUPPLY
32
30
36
34
15
26
27
25
24
$d_1$
$d_2$
22
14
18
16
202
12
MECHANICAL LINEAR ACTUATOR
101
201
100
18
22
14
16
20

LOAD LIMIT SYSTEM FOR MECHANICAL LINEAR ACTUATOR

The invention described herein may be manufactured and used by or for the Government of the United States of America for governmental purposes without payment of any royalties thereon or therefor.

FIELD OF THE INVENTION

The invention relates generally to control of a linearly imparted load force, and more particularly to a load limit system that limits linear movement of a mechanical linear actuator device based on a selected load limit.

BACKGROUND OF THE INVENTION

Mechanical linear actuators (e.g., ball screw actuators, hydraulic or pneumatic actuators, rack-and-pinion actuators, etc.) are well known in the art as being simple, quiet and reliable. In particular, mechanical linear actuators are capable of accurately positioning and imparting large load forces along a given linear direction. Generally, the actuator is driven until it stops at predetermined position. Position of the actuator is then maintained independent of the load force being applied (assuming the load force is within the capability of the actuator). For example, the actuator can be rigidly locked in position by braking the actuator's input shaft. Unfortunately, the simplicity of the mechanical linear actuator translates into an inherent lack of load force control in terms of establishing limits on the load forces.

SUMMARY OF THE INVENTION

Accordingly, it is an object of the present invention to provide a load limit system for a linear actuator.

Another object of the present invention is to provide a load limit system for a linear actuator that defines an operational load bandwidth.

Other objects and advantages of the present invention will become more obvious hereinafter in the specification and drawings.

In accordance with the present invention, a load limit system is provided for a linear actuator. An interface is attached to the linear actuator and is disposed between first and second spring assemblies. The interface defines a datum at which the first and second spring assemblies are at rest. The interface imparts a load force to the first spring assembly when the interface is moved in a first direction by the linear actuator. Similarly, the interface imparts the load force to the second spring assembly when the interface is moved in a second direction by the linear actuator. The first and second directions are such that they oppose one another. A first sensor is positioned a first distance from the datum for sensing a first amount of linear compression of the first spring assembly along the first direction. A second sensor is positioned a second distance from the datum for sensing a second amount of linear compression of the second spring assembly along the second direction. Movement of the linear actuator in the first direction ceases whenever the first amount of linear compression is sensed. Movement of the linear actuator in the second direction ceases whenever the second amount of linear compression is sensed.

BRIEF DESCRIPTION OF THE DRAWINGS

The sole Figure is a system level diagram showing the load limit system of the present invention in conjunction with a mechanical linear actuator that the present invention controls.

DETAILED DESCRIPTION OF THE INVENTION

Referring now to the sole Figure, mechanical linear actuator 100 is shown in conjunction with the load limit system according to the present invention. Mechanical linear actuator 100 can be any of a variety of well known mechanical linear actuators. Regardless of the type of mechanical linear actuator, actuator 100 generally includes actuator shaft 101 driven to move linearly in one of either direction indicated by arrows 201 and 202.

The load limit system includes actuator plate 12 connected to actuator rod 101 such that actuator plate 12 moves in conjunction with actuator rod 101 in either direction 201 or direction 202. Disposed on either side of actuator plate 12 are springs 14 on one side thereof and springs 16 on an opposite side thereof. Springs 14 have a spring constant $k_1$ and springs 16 have a spring constant $k_2$. Spring constants $k_1$ and $k_2$ can be, but need not be, equal to one another. By way of example, two of springs 14 and two of springs 16 are shown. However, more or less springs can be used on either side of actuator plate 12. Regardless of the number of springs 14 or springs 16, springs 14 and springs 16 have an at rest position in which each of springs 14 and 16 are under a no load condition. Practically, in the no load condition, each of springs 14 and springs 16 will be in slight contact with actuator plate 12 prior to the activation of actuator 100. Accordingly, in this at rest position, adapter plate 12 defines a reference datum defining the no load condition. This reference datum is designated in the drawings by dashed lines tagged with reference numeral 15.

To retain and guide springs 14 and springs 16 springs, guide posts 18 pass through actuator plate 12, springs 14 and springs 16. Guide posts 18 terminate and are fixed at one end thereof in base 20, and terminate at the other end thereof in caps 22. In order to act as a guide for actuator plate 12, guide posts 18 are parallel with the linear directions of movement of actuator rod 101 represented by direction arrows 201 and 202.

Detection switches 24 and 26 are positioned on either side of actuator plate 12 at respective (selected) distances $d_1$ and $d_2$ from reference datum 15. Detection switches 24 and 26 can be any conventional contact switch, photo sensitive switch, etc., that is activated when actuator plate 12 reaches same when traveling in respective directions 201 and 202. Distances $d_1$ and $d_2$ may be the same or different distances. Typically, switch 24 is mounted on boss 25 attached to cap 22 while switch 26 is mounted on boss 27 attached to base 20. As will be explained further below, proper positioning of switches 24 and 26 determines an operational load bandwidth for actuator 100.

Since the spring forces of springs 14 or springs 16 must be overcome by actuator plate 12 moving in direction 201 or direction 202, and since springs constants $k_1$ for springs 14 and $k_2$ for springs 16 are known in advance, selection of distances $d_1$ and $d_2$ presets the amount of acceptable load in direction 201 ($d_1*k_1$) and the amount of acceptable load in direction 202 ($d_2*k_2$). Thus, load forces imparted by actuator plate 12 during movement in either direction 201 and 202 are directly and linearly related to the amount of travel of actuator plate 12 with respect to reference datum 15.

Control system 30 is used to control actuator 100 in terms of the operational power applied thereto based on the amount of load force imparted by actuator plate 12 driven in either direction 201 or direction 202. By way of non-limiting example, control system 30 consists of power supply 32 supplying power to actuator 100 through switch 34 which is biased closed. Any changes in the position of switch 34 are controlled by the output of OR gate 36 which goes HIGH to open switch 34 if either switch 24 or 26 is activated by actuator plate 12. Output of OR gate 36 is LOW to keep switch 34 in its (bias) closed position whenever actuator plate 12 is located/traveling between switches 24 and 26.

In operation, when actuator 100 is powered and configured such that actuator plate 12 is retracted from reference datum 15 in direction 201, actuator plate 12 compresses springs 14 until the preset load (established by distance $d_1$ and spring constant $k_1$) is reached. Switch 24 is then activated causing the output of OR gate 36 to go HIGH to open switch 34. Once power is removed from actuator 100 in this fashion, springs 14 are biased for expansion causing actuator plate 12 to move away from switch 24 which in turn causes OR gate 36 to again return to the LOW state that allows switch 34 to close. Then, as long as actuator 100 is configured to move actuator rod 101 in direction 201, actuator plate 12 will again begin to compress springs 14. Operation of load system 10 is similar when actuator 100 is configured to extend actuator rod 101 (and thus actuator plate 12) in direction 202. Thus, distances $d_1$ and $d_2$ in combination with spring constants $k_1$ and $k_2$ define the operational load bandwidth of the system in a simple linear fashion.

The standard features (e.g., simplicity, reliability and quietness) of a conventional mechanical linear actuator are enhanced by the simple, directly linear load sensing and limit system of the present invention. The direct linear nature of the system allows load limitations to be preset based simply on the amount of linear travel of the system's actuator plate. Further allowable retraction load forces can be set independently of extension load forces.

The present invention will find great utility in a wide variety of applications owing to its ability to smoothly deliver a load force since there are no hydraulics or pneumatics which must remain under pressure whenever force is to be applied and which can introduce stick and/or slip motion. One such application is a material (e.g., trash) compactor where it is desirable to apply a load force to a reaction load to essentially eliminate air pockets in the reaction load. Thus, the load must be applied continuously but yet not exceed the load handling capability of the machine. The present invention provides the means of easily setting the load limits that define a particular machine's operational load bandwidth. Further, since the present invention involves no hydraulics, the complexity, cost, leaking and noise problems associated with such systems are not present.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed is:

1. A load limit system for a linear actuator, comprising:

first spring means;

second spring means;

an interface attached to a linear actuator and disposed between said first spring means and said second spring means, said interface imparting a load force to one of said first spring means and said second spring means when said interface is moved in one of two opposing directions by said linear actuator; and sensing means for sensing a first amount of linear compression of said first spring means when said interface imparts a load force to compress said first spring means, and for sensing a second amount of linear compression of said second spring means when said interface imparts a load force to compress said second spring means, wherein said interface ceases to impart a load force whenever one of said first amount of linear compression and said second amount of linear compression is sensed.

2. A load limit system as in claim 1 wherein a spring constant associated with said first spring means is different than a spring constant associated with said second spring means.

3. A load limit system as in claim 1 wherein said sensing means comprises:

a first sensor for detecting only said first amount of linear compression; and a second sensor for detecting only said second amount of linear compression.

4. A load limit system for a linear actuator, comprising:

first spring means;

second spring means;

an interface attached to a linear actuator and disposed between said first spring means and said second spring means to define a reference position at which said first and second spring means are at rest, said interface imparting a load force to said first spring means when said interface is moved in a first direction by said linear actuator, said interface alternatively imparting said load force to said second spring means when said interface is moved in a second direction by said linear actuator, wherein said first and second directions oppose one another;

first sensing means positioned a first distance from said datum for sensing a first amount of linear compression of said first spring means along said first direction when said interface imparts said load force to compress a first spring means;

second sensing means positioned a second distance from said datum for sensing a second amount of linear compression of said second spring means along said second direction when said interface imparts said load force to compress a second spring means, wherein movement of said linear actuator in said first direction ceases whenever said first amount of linear compression is sensed and movement of said linear actuator in said second direction ceases whenever said second amount of linear compression is sensed.

5. A load limit system as in claim 4 wherein said first sensing means comprises a first switch that outputs a first control signal when said first amount of linear compression is not sensed and outputs a second control signal when said first amount of linear compression is sensed, and wherein said second sensing means comprises a second switch that outputs a first control signal when said second amount of linear compression is not sensed and outputs a second control signal when said second amount of linear compression is sensed.

6. A load limit system as in claim 5 further comprising a control system connecting said linear actuator with said first switch and said second switch, said control system for powering said linear actuator to move in one of said first direction and said second direction in response to the presence of a combination of said first control signal from said first switch and said first control signal from said second switch, and for removing power from said linear actuator in response to one of said second control signal from said first switch and said second control signal from said second switch.

7. A load limit system as in claim 4 wherein a spring constant associated with said first spring means is different than a spring constant associated with said second spring means.

8. A load limit system as in claim 4 further comprising a plurality of guide posts distributed about said interface and extending normal thereto in each of said first direction and said second direction, said first spring means disposed about said plurality of guide posts extending in said first direction, and said second spring means disposed about said plurality of guide posts extending in said second direction.

* * * * *